US012509837B2

(12) United States Patent
Lee et al.

(10) Patent No.: US 12,509,837 B2
(45) Date of Patent: Dec. 30, 2025

(54) DETACHABLE MOORING SYSTEM FOR OFFSHORE STRUCTURE

(71) Applicants: KOREA INSTITUTE OF OCEAN SCIENCE & TECHNOLOGY, Busan (KR); KOMS INC., Busan (KR); DHMC CO., LTD., Yeongam-gun (KR)

(72) Inventors: Kang Su Lee, Incheon (KR); Hong Gun Sung, Busan (KR); Byoung Jae Park, Daejeon (KR); Jang Jin Kim, Busan (KR); Hyun Kook Kim, Busan (KR); Chang Hwan Seo, Busan (KR); Kyung Seok Lee, Geoje-si (KR); Yoon Yong Park, Busan (KR)

(73) Assignees: KOREA INSTITUTE OF OCEAN SCIENCE & TECHNOLOGY, Busan (KR); KOMS INC., Busan (KR); DHMC CO., LTD., Jeollanam-do (KR)

( * ) Notice: Subject to any disclaimer, the term of this patent is extended or adjusted under 35 U.S.C. 154(b) by 254 days.

(21) Appl. No.: 18/403,425

(22) Filed: Jan. 3, 2024

(65) Prior Publication Data

US 2024/0150985 A1 May 9, 2024

Related U.S. Application Data

(63) Continuation of application No. PCT/KR2022/005159, filed on Apr. 8, 2022.

(30) Foreign Application Priority Data

Nov. 12, 2021 (KR) ..... 10-2021-0155932

(51) Int. Cl.
*B63B 21/18* (2006.01)
*E02B 3/24* (2006.01)

(52) U.S. Cl.
CPC ..... *E02B 3/24* (2013.01); *B63B 21/18* (2013.01)

(58) Field of Classification Search
CPC ..... B63B 21/00; B63B 21/04; B63B 21/08; B63B 21/10; B63B 21/20; B63B 2021/003; B63B 2021/004; B63B 21/18; E02B 3/24
See application file for complete search history.

(56) References Cited

U.S. PATENT DOCUMENTS

2006/0060126 A1 3/2006 Dove et al.
2010/0024706 A1 2/2010 Foo et al.
(Continued)

FOREIGN PATENT DOCUMENTS

CN 116714717 A * 9/2023 ..... B63B 21/50
KR 10-2014-0126022 A 10/2014
(Continued)

OTHER PUBLICATIONS

Korean Office Action of KR 10-2021-0155932 dated Apr. 10, 2023.
Korean Notice of Allowance of KR 10-2021-0155932 dated Jun. 21, 2023.

*Primary Examiner* — Andrew Polay
(74) *Attorney, Agent, or Firm* — Dinsmore & Shohl LLP; Yongsok Choi, Esq.

(57) ABSTRACT

Proposed is a detachable mooring system for an offshore structure, including a first tension adjuster connected to an offshore structure, and blocking a pulling chain from proceeding from an outlet of a body toward an inlet, a second tension adjuster connected to one end of the pulling chain and blocking the pulling chain from proceeding from an outlet of a body toward an inlet, a mooring chain having a first longitudinal end connected to one surface of the second tension adjuster body and having a second longitudinal end connected to an anchor on the seabed, a first lead rope
(Continued)

having one longitudinal end connected to one end of the pulling chain discharged out through the first tension adjuster outlet, and a second lead rope having one longitudinal end connected to the second tension adjuster body.

4 Claims, 8 Drawing Sheets

(56) References Cited

U.S. PATENT DOCUMENTS

| | | | | |
|---|---|---|---|---|
| 2017/0349243 | A1* | 12/2017 | Lisland | B63B 21/18 |
| 2019/0161144 | A1* | 5/2019 | Trouve | B63B 21/18 |
| 2020/0055569 | A1 | 2/2020 | Atallah et al. | |

FOREIGN PATENT DOCUMENTS

| | | | |
|---|---|---|---|
| KR | 10-2015-0084913 | A | 7/2015 |
| KR | 10-2017-0043340 | A | 4/2017 |
| KR | 10-2020-0003066 | A | 1/2020 |
| WO | 2020/165568 | A1 | 8/2020 |

* cited by examiner

DETACHABLE MOORING SYSTEM FOR OFFSHORE STRUCTURE

CROSS-REFERENCE TO RELATED APPLICATIONS

This application is a continuation of International Application No. PCT/KR2022/005159 filed on Apr. 8, 2022, which claims priority to Korean Patent Application No. 10-2021-0155932 filed on Nov. 12, 2021, the entire contents of which are herein incorporated by reference.

TECHNICAL FIELD

The present disclosure relates to a detachable mooring system for an offshore structure. More particularly, the present disclosure relates to a detachable mooring system for an offshore structure, the detachable mooring system being capable of easily performing mooring of an offshore structure and of quickly and safely performing relocation of the moored offshore structure in emergency situations such as port movement requirements for emergency maintenance or typhoons.

BACKGROUND ART

In the case of offshore structures, such as offshore wind turbines, they are inevitably affected by waves and currents due to their location on the sea.

Therefore, when an offshore structure moves due to the effects of waves and currents, the offshore structure may not only be lost due to excessive movement, but also be damaged by collapse.

Various mooring devices or mooring systems, such as those disclosed in Korean Patent Application Publication No. 10-2014-0126022, are used to secure an offshore structure to a point on the sea.

At this point, since an offshore structure such as an offshore wind turbine has a significant size and load, a mooring device for the offshore structure also has a significant size and load. Therefore, not only is it difficult to manufacture an offshore structure, but installation thereof also requires considerable time, manpower, and equipment, which causes a problem of reducing the efficiency of installation work.

Furthermore, a conventional mooring device for an offshore structure has a complex structure because it includes, for example, multiple links. When relocation of an offshore structure is required in emergency situations such as port movement requirements for emergency maintenance or typhoons, respective connection of the multiple links should be disconnected to remove binding between the offshore structure and the mooring device. At this time, the disconnection inevitably requires more time, manpower, and equipment, and therefore, relocation of the offshore structure cannot be performed quickly. There may be problems of damage caused due to delayed maintenance and serious damage to the offshore structure due to the effects of typhoons, etc.

For the above reasons, in this field, attempts are being made to develop mooring systems for offshore structures that can facilitate mooring of an offshore structure and can quickly and safely relocate a moored offshore structure in emergency situations such as port movement requirements for emergency maintenance or typhoons, but satisfactory results have not been obtained to date.

DOCUMENTS OF RELATED ART

Patent Document (Patent Document 1) Korean Patent Application Publication No. 10-2014-0126022

DISCLOSURE

Technical Problem

The present disclosure has been made keeping in mind the above problems occurring in the related art, and the present disclosure is intended to propose a mooring system for an the offshore structure, the mooring system being capable of easily performing mooring of an offshore structure and of quickly and safely performing relocation of the moored offshore structure in emergency situations such as port movement requirements for emergency maintenance or typhoons.

Technical Solution

In order to achieve the above objective, the present disclosure proposes a detachable mooring system for an offshore structure.

The detachable mooring system for an offshore structure includes: a first tension adjuster connected to an offshore structure to be a moored object, and configured to block advance of a pulling chain, which is inserted through an inlet of a body and is discharged out through an outlet, in a direction from the outlet toward the inlet; a second tension adjuster connected to one end of the pulling chain connected to an outer portion of the inlet of the first tension adjuster, and configured to block advance of the pulling chain, which is inserted through an inlet of a body and is discharged out through an outlet, in a direction from the outlet toward the inlet; a mooring chain having a first longitudinal end connected to any one surface of the body of the second tension adjuster, and a second longitudinal end connected to an anchor settled on the sea bed; a first lead rope having one longitudinal end, which is connected to one end of the pulling chain discharged out through the outlet of the first tension adjuster; and a second lead rope having one longitudinal end connected to the body of the second tension adjuster.

Advantageous Effects

According to the present disclosure, the detachable mooring system for an offshore structure includes the first tension adjuster, the second tension adjuster, the mooring chain, the first lead rope, and the second lead rope. Therefore, the detachable mooring system has a relatively simple structure, thereby facilitating manufacturing and installation thereof.

Furthermore, the detachable mooring system for an offshore structure of the present disclosure is configured such that the pulling chain extending from the first tension adjuster is connected to the second tension adjuster and the mooring chain extending from the anchor is connected to the second tension adjuster, so that mooring of the offshore structure to be a moored object can be simply completed. Therefore, mooring of the offshore structure can be easily performed, thereby improving efficiency of mooring work of the offshore structure.

Furthermore, the detachable mooring system for an offshore structure according to the present disclosure is configured such that one end of the pulling chain extending from the first tension adjuster on the water is pulled or one end of the pulling chain extending from the second tension adjuster in the water is pulled, so that tension adjustment in a moored state can be performed. Therefore, the moored state of the offshore structure can be stably maintained by the tension adjustment.

Furthermore, each of the first tension adjuster and the second tension adjuster of the detachable mooring system for an offshore structure according to the present disclosure includes the pulling member and the wireless controller. Therefore, the pulling member may lock and unlock the restrictor of the first tension adjuster and the second tension adjuster manually. Additionally, the wireless controller may lock and unlock the restrictor of the first tension adjuster and the second tension adjuster automatically. Accordingly, tension adjustment using the first tension adjuster and the second tension adjuster can be easily performed.

DETAILED DESCRIPTION

Hereinbelow, the present disclosure will be described in detail with reference to accompanying drawings.

Figure 1:
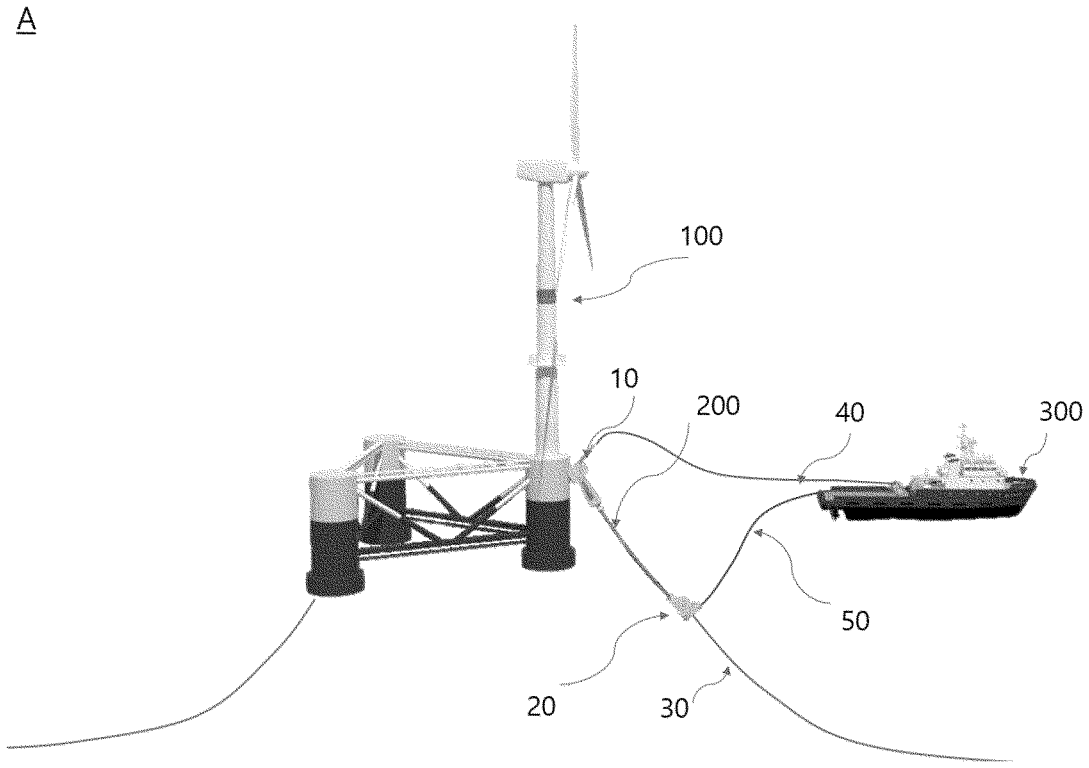
FIG. 1 is a view of an example showing a form of a detachable mooring system for an offshore structure according to the present disclosure, the detachable mooring system being applied to an offshore structure.

As shown in FIG. 1, a detachable mooring system A for an offshore structure according to the present disclosure includes: a first tension adjuster 10; a second tension adjuster 20; a mooring chain 30; a first lead rope 40; and a second lead rope 50.

The first tension adjuster 10 of the present disclosure is connected to an offshore structure 100 to be a moored object, and blocks advance of a pulling chain 200, which is inserted through an inlet 11*a* of a body 11 and is discharged out through an outlet 11*b*, in a direction from the outlet 11*b* toward the inlet 11*a*.

Figure 5:
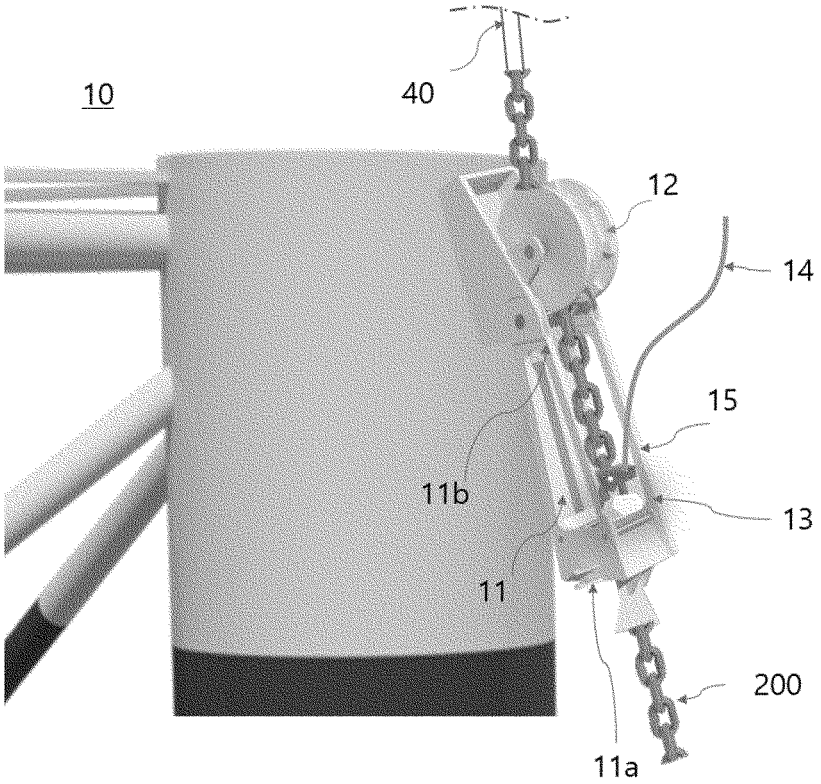
FIG. 5 is a front view showing a structure of the first tension adjuster of the detachable mooring system for an offshore structure according to the present disclosure.

At this point, as shown in FIG. 5, the first tension adjuster 10 includes: a pulley 12 rotatably arranged at the body 11 and brought into contact with the pulling chain 200; and a restrictor 13 connected to the pulley 12 and configured to restrict uni-directional rotation of the pulley 12 with being locked. Accordingly, as uni-directional rotation of the pulley 12 is restricted by locking of the restrictor 13, the advance from the outlet 11*b* of the pulling chain 200 toward the inlet 11*a* may be blocked.

At this point, the restrictor 13 may use any known structures and methods as long as it can restrict uni-directional rotation of the pulley 12 as locking of the restrictor 13 is performed, and detailed description of the restrictor 13 will be omitted.

In addition, the first tension adjuster 10 includes a pulling member 14, the pulling member 14 being configured to remove the locked state by pulling the restrictor 13. Accordingly, when the pulling member 14 is pulled manually, the locked state of the restrictor 13 is removed and the pulling chain 200 can be moved forward from the outlet 11*b* toward the inlet 11*a*.

In addition, the first tension adjuster 10 includes a wireless controller 15 configured to lock and unlock the restrictor 13 in response to a control signal from a remote location. Accordingly, the locked state of the restrictor 13 is removed according to control of the wireless controller 15, and the pulling chain can be moved forward from the outlet 11*b* toward the inlet 11*a*.

At this point, the wireless controller 15 may use any known structures and methods as long as it can lock and unlock the restrictor 13 according to a control signal of a remote location, and detailed description of the wireless controller 15 will be omitted.

Figure 2:
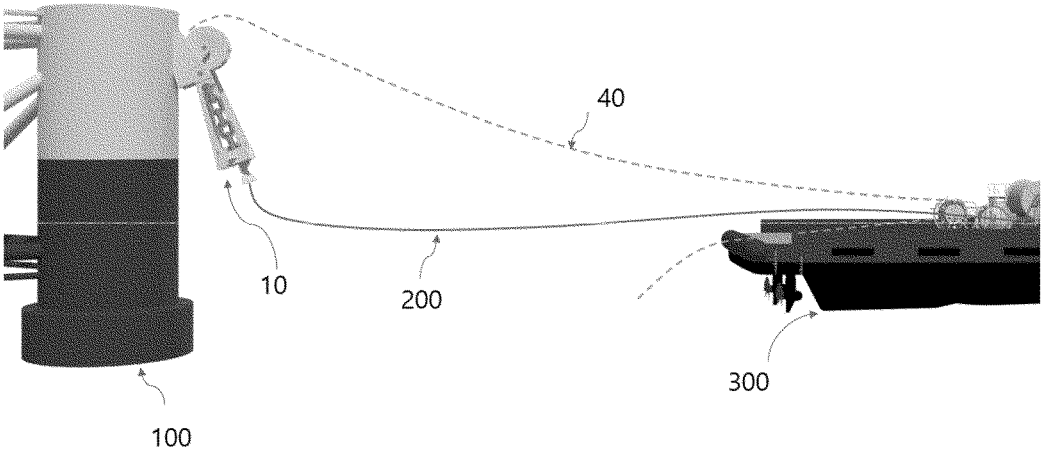
FIG. 2 is a view of an example showing towing of an offshore structure by using a first tension adjuster and a first lead rope of the detachable mooring system for an offshore structure according to the present disclosure.

Meanwhile, the first tension adjuster 10 is connected to the offshore structure 100 from the start while being coupled with the pulling chain 200 and, specifically is connected to any one bollard (without reference numeral) constituting the offshore structure 100. Accordingly, as shown in FIG. 2, when the pulling chain 200 and the first lead rope 40 connected thereto are pulled using a winch equipped in a ship 300, towing the first tension adjuster 10 is achieved and additionally towing of the offshore structure may be achieved.

The second tension adjuster 20 of the present disclosure is connected to one end of the pulling chain 200 connected to an outer portion of the inlet 11*a* of the first tension adjuster 10. The second tension adjuster 20 blocks the advance of the pulling chain 200, which is inserted through the inlet 11*a* of a body 21 and is discharged out through an outlet 21*b*, in a direction from the outlet 21*b* toward the inlet 21*a*.

Figure 6:
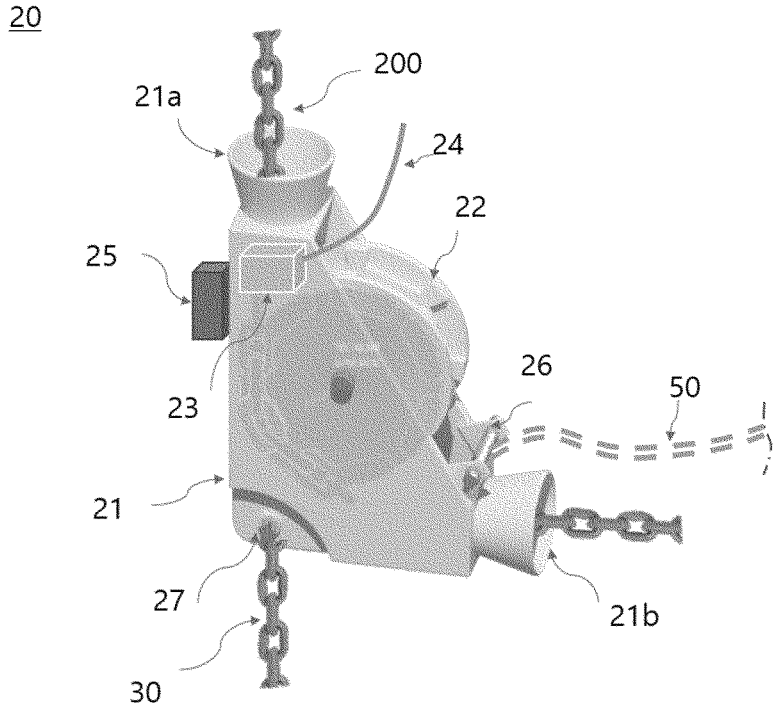
FIG. 6 is a front view showing a structure of the second tension adjuster of the detachable mooring system for an offshore structure according to the present disclosure.

At this point, as shown in FIG. 6, the second tension adjuster 20 includes: a pulley 22 rotatably arranged at the body 21 and brought into contact with the pulling chain 200; and a restrictor 23 connected to the pulley 22 and configured to restrict uni-directional rotation of the pulley 22 with being locked. Accordingly, as uni-directional rotation of the pulley 22 is restricted by locking of the restrictor 23, the advance from the outlet 21*b* of the pulling chain 200 toward the inlet 21*a* may be blocked.

At this point, the restrictor 23 may use any known structures and methods as long as it can restrict uni-directional rotation of the pulley 22 as locking of the restrictor 23 is performed, and detailed description of the restrictor 23 will be omitted.

In addition, the second tension adjuster 20 includes a pulling member 24, which is configured to remove the locked state by pulling the restrictor 23. Accordingly, when the pulling member 24 is pulled manually, the locked state of the restrictor 23 is removed and the pulling chain 200 can be moved forward from the outlet 21*b* toward the inlet 21*a*.

In addition, the second tension adjuster 20 includes a wireless controller 25 configured to lock and unlock the restrictor 23 in response to a control signal from a remote location. Accordingly, the locked state of the restrictor 23 is removed according to control of the wireless controller 25, and the pulling chain 200 can be moved forward from the outlet 21*b* toward the inlet 21*a*.

At this point, the wireless controller 25 may use any known structures and methods as long as it can lock and unlock the restrictor 23 according to a control signal of a remote location, and detailed description of the wireless controller 25 will be omitted.

In addition, the second tension adjuster 20 includes a link member 26 arranged at one surface of the body 21. Accordingly, as the second lead rope 50 is bound to the link member 26, connection of the second lead rope 50 to the second tension adjuster 20 may be achieved.

In addition, the second tension adjuster 20 includes a binding member 27 arranged at one surface of the body 21. Accordingly, the mooring chain 30 extending from an anchor 31 is bound to the binding member 27, and accordingly the mooring chain 30 may be connected to the second tension adjuster 20.

A first longitudinal end of the mooring chain 30 of the present disclosure is connected to one surface of the body 21 of the second tension adjuster 20 and a second longitudinal end thereof is connected to the anchor 31 is settled on the sea bed.

At this point, the mooring chain 30 may be connected to the second tension adjuster 20 as the first longitudinal end thereof is bound to the binding member 27 provided at the second tension adjuster 20.

Figure 3:
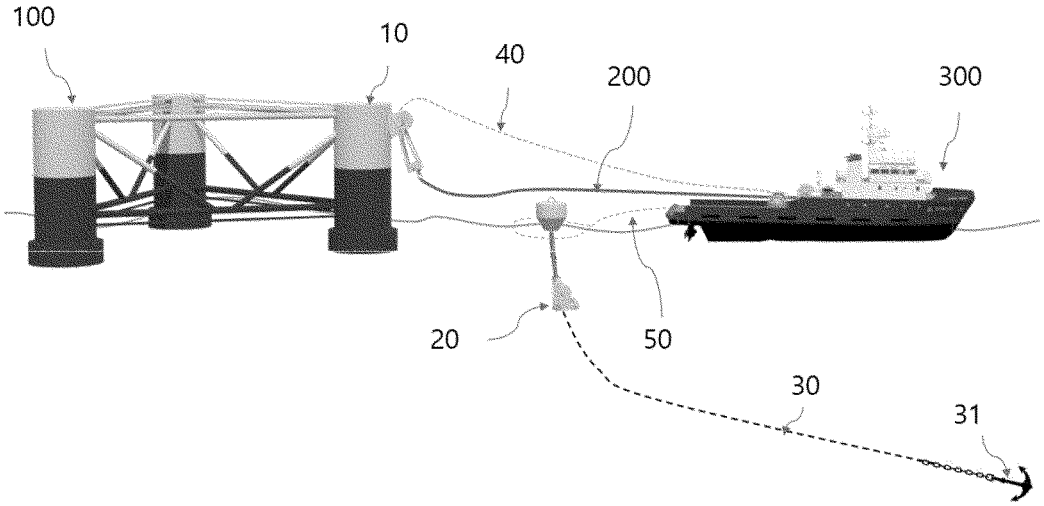
FIG. 3 is a view of an example showing mooring chain towing by using a second lead rope of the detachable mooring system for an offshore structure according to the present disclosure.

Meanwhile, the mooring chain 30 is connected to the second tension adjuster 20 at first. Accordingly, as shown in FIG. 3, the second lead rope 50 connected to the second tension adjuster 20 is pulled using the winch (without reference numeral) arranged at the ship 300, and accordingly towing of the second tension adjuster 20 is achieved and also towing the mooring chain 30 may be achieved.

A first longitudinal end of the first lead rope of the present disclosure is connected to one end of the pulling chain 200 discharged out through the outlet 11*b* of the first tension adjuster 10.

Therefore, towing the offshore structure 100 or tension adjustment of the pulling chain 200 may be achieved as a second longitudinal end of the first lead rope 40 is pulled using the winch arranged at the ship 300.

Meanwhile, the offshore structure 100 may be restrained from unintentionally moving while being exposed outwards as the second longitudinal end of the first lead rope 40 is bound to the offshore structure 100 in situations other than towing or tension adjustment.

A first longitudinal end of the second lead rope 50 of the present disclosure is connected to the body 21 of the second tension adjuster 20.

Accordingly, the second tension adjuster 20 and the mooring chain 30 connected to the second tension adjuster may be towed as a second longitudinal end of the second lead rope 50 is pulled using the winch arranged at the ship 300.

At this point, the second lead rope 50 may be connected to the second tension adjuster 20 as the first longitudinal end of the second lead rope 50 is bound to the link member 26 arranged at one surface of the body 21 of the second tension adjuster 20.

Meanwhile, the offshore structure 100 may be restrained from unintentionally moving while being exposed outwards as the second longitudinal end of the second lead rope 50 is bound to the offshore structure 100 in situations other than towing or tension adjustment.

Furthermore, additionally, the detachable mooring system A for an offshore structure of the present disclosure may include a connecting rope 60.

At this point, a first longitudinal end of the connecting rope 60 is connected to one end of the pulling chain 200 discharged out through the outlet 21*b* of the second tension adjuster 20. Accordingly, a tension of the pulling chain 200 may be adjusted as a second longitudinal end of the connecting rope 60 is pulled using the winch arranged at the ship 300.

Hereinbelow, mooring the offshore structure 100 by using the detachable mooring system A for an offshore structure of the present disclosure will be described in detail.

First, the offshore structure 100 and the mooring chain 30 are transferred to one point on the sea.

At this point, the first tension adjuster 10 is connected to the offshore structure 100, the pulling chain 200 is connected to the first tension adjuster 10, and the first lead rope 40 is connected to the first longitudinal end of the pulling chain 200 discharged out through the outlet 11*b* of the body 11 of the first tension adjuster 10.

The second tension adjuster 20 is connected to the first longitudinal end of the mooring chain 30, and the second lead rope 50 is connected to the body 21 of the second tension adjuster 20.

Meanwhile, the mooring chain 30 transferred to one point on the sea is located on the sea by being inserted into the sea with one end thereof connected to a buoy (without reference numeral).

At this point, the buoy is seated from the mooring chain 30 in a process in which the first tension adjuster 10 and the second tension adjuster 20 are connected to each other, so that the mooring chain 30 may be located underwater.

Next, the first tension adjuster 10 and the second tension adjuster 20 are connected to each other.

Figure 4:
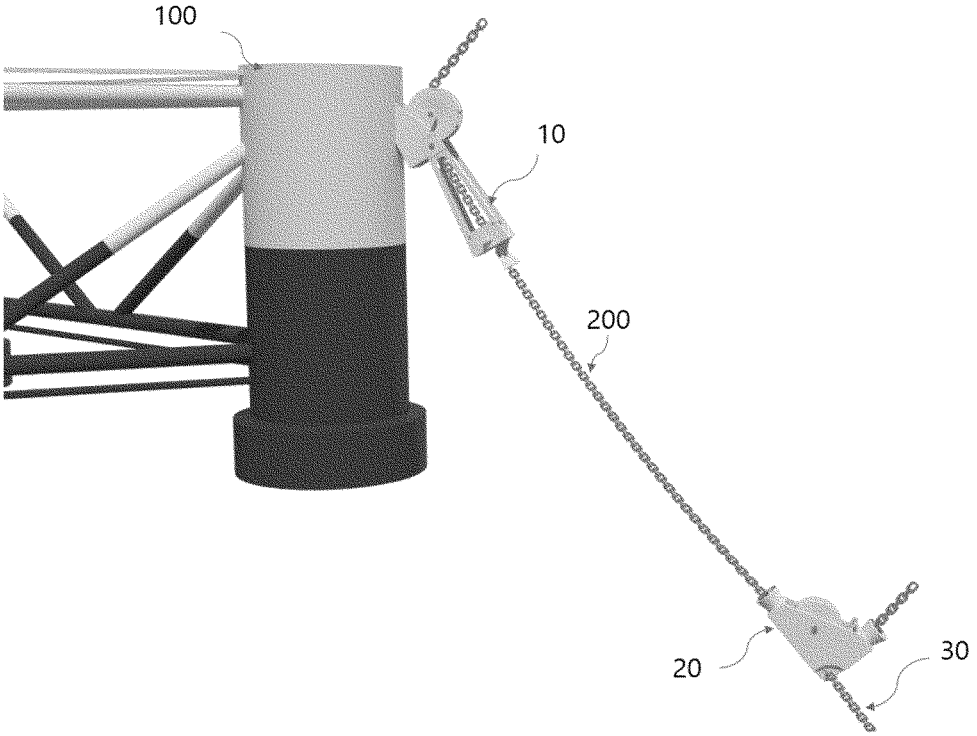
FIG. 4 is a view of an example showing connection between the first tension adjuster and a second tension adjuster of the detachable mooring system for an offshore structure according to the present disclosure.

At this point, as shown in FIG. 4, the second tension adjuster 20 is connected to one longitudinal end of the pulling chain 200 extending from the first tension adjuster 10. Accordingly, the pulling chain 200 may allow connection between the first tension adjuster 10 and the second tension adjuster 20 to be achieved.

At this point, the pulling chain 200 extending from the first tension adjuster 10 may be connected to the second tension adjuster 20 as the longitudinal end thereof is inserted through the inlet 21*a* of the body 21 of the second tension adjuster 20 and is discharged out through the outlet 21*b*.

Meanwhile, connection between the first tension adjuster 10 and the second tension adjuster 20 is performed while the second tension adjuster 20 is towed on a ship thereby minimizing underwater operation.

Next, tension adjustment is performed while the second tension adjuster 20 and the mooring chain 30 are inserted into the water.

Figure 7:
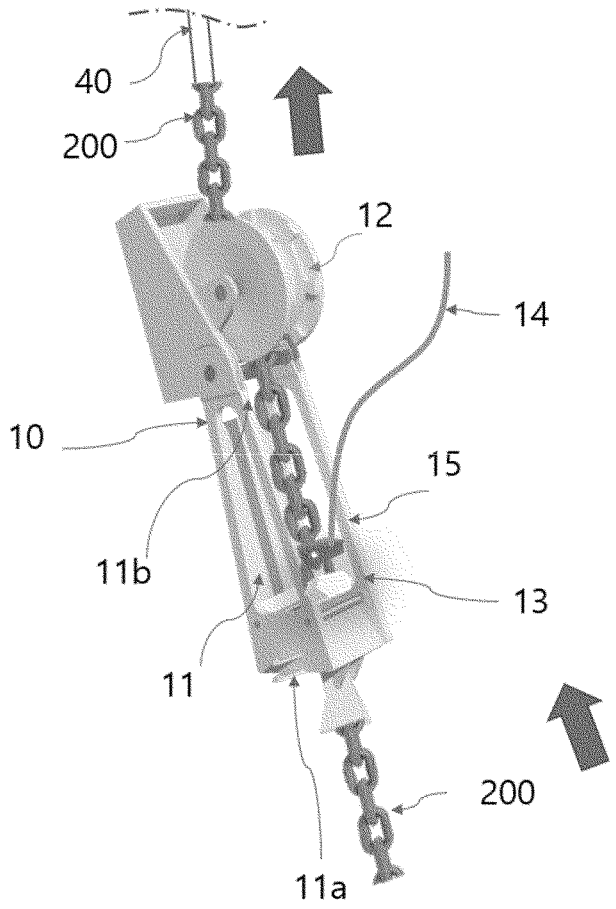
FIG. 7 is a view of an example showing tension adjustment by the first tension adjuster of the detachable mooring system for an offshore structure according to the present disclosure.

In the present disclosure, one longitudinal end of the pulling chain 200 is discharged out through the outlet 11*b* of the body 11 of the first tension adjuster 10, and the longitudinal end of the pulling chain 200 is connected to the first lead rope 40. As shown in FIG. 7, the first lead rope 40 is pulled using the winch arranged at the ship 300, and accordingly the offshore structure 100 and the anchor 31 are tightened therebetween, i.e., the pulling chain 200 and the mooring chain 30 are tightened, thereby achieving tension adjustment.

Figure 8:
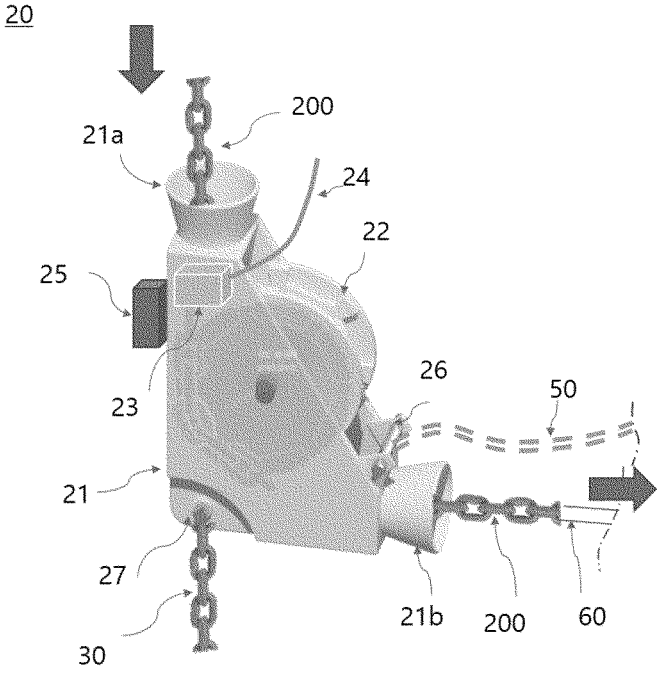
FIG. 8 is a view of an example showing tension adjustment by the second tension adjuster of the detachable mooring system for an offshore structure according to the present disclosure.

Furthermore, in the present disclosure, another longitudinal end of the pulling chain 200 is discharged out through the outlet 21*b* of the body 21 of the second tension adjuster 20, and the connecting rope 60 is connected to the longitudinal end of the pulling chain 200. As shown in FIG. 8, the connecting rope 60 is pulled using the winch arranged at the ship 300, and accordingly the offshore structure 100 and the anchor 31 are tightened therebetween, i.e., the pulling chain 200 and the mooring chain 30 are tightened, thereby achieving tension adjustment.

However, each of the first tension adjuster 10 and the second tension adjuster 20 blocks the uni-directional advance of the pulling chain 200 by restricting uni-directional rotation of the pulley 12, 22 by the restrictor 13, 23. Tension adjustment may be difficult by blocking the uni-directional advance of the pulling chain 200.

However, in the present disclosure, each of the first tension adjuster 10 and the second tension adjuster 20 includes a pulling member 14, 24. When the pulling member 14, 24 is pulled manually, locking of the restrictor 13, 23 may be removed. Accordingly, the uni-directional advance of the pulling chain 200 is released, in other words, bi-directional advance thereof may be achieved, so that tension adjustment by pulling the pulling chain 200 may be efficiently achieved.

Furthermore, in the present disclosure, each of the first tension adjuster 10 and the second tension adjuster includes a wireless controller 15, 25. Locking of the restrictor 13, 23 may be removed by control of the wireless controller 15, 25 in response to a control signal from a remote location. Accordingly, the uni-directional advance of the pulling chain 200 is released, in other words, the bi-directional advance thereof may be achieved, so that tension adjustment by pulling the pulling chain 200 may be efficiently achieved.

Meanwhile, the detachable mooring system A for an offshore structure according to the present disclosure may efficiently relocate the moored offshore structure 100 in emergency situations such as port movement requirements for emergency maintenance or typhoons.

In other words, while the offshore structure 100 is moored, one end of each of the first lead rope 40 and the second lead rope 50 of the present disclosure is bound to the offshore structure 100 to be exposed outwards. In emergency situations such as port movement requirements for emergency maintenance or typhoons, the end of the first lead rope 40 and the second lead rope 50 bound to the offshore structure 100 is unbound and connected to the winch arranged at the ship 300 and then is pulled, thereby allowing not only the offshore structure 100 to be towed but also the second tension adjuster 20 to be towed. Accordingly, connection between the first tension adjuster 10 and the second tension adjuster 20 may be simply removed as the second tension adjuster 20 is towed to the ship and the pulling chain 200 is separated therefrom.

Therefore, while connection between the first tension adjuster 10 and the second tension adjuster 20 is removed, the pulling chain 200 and the first lead rope 40 that extend from the first tension adjuster 10 is connected to the ship 300 to move the ship 300. Accordingly, the offshore structure 100 connected to the first tension adjuster 10 is transferred, thereby quickly and safely performing relocation.

At this point, the second tension adjuster 20 released from connection with the first tension adjuster 10 may maintain a previous installation location as the second tension adjuster 20 connected to the buoy is re-put into the water. Therefore, when mooring of the offshore structure 100 is required in the future, the second tension adjuster located in the water is towed and is connected to the first tension adjuster 10, and accordingly the offshore structure 100 may be re-located at the point before relocation.

The present disclosure described above is not limited to the above-mentioned embodiment and those skilled in the art will appreciate that various modifications, additions and substitutions are possible, without departing from the scope and spirit of the present disclosure as disclosed in the accompanying claims, and the modifications, additions and substitutions are within the scope of the protection of the patent right of the present disclosure that are defined by description of the claims.

[Description of Reference numerals]

| | |
|---|---|
| 10: first tension adjuster | 11: body |
| 11a: inlet | 11b: outlet |
| 12: pulley | 13: restrictor |
| 14: pulling member | 15: wireless controller |
| 20: second tension adjuster | 21: body |
| 21a: inlet | 21b: outlet |
| 22: pulley | 23: restrictor |
| 24: pulling member | 25: wireless controller |
| 26: link member | 27: binding member |
| 30: mooring chain | 31: anchor |
| 40: first lead rope | 50: second lead rope |
| 60: connecting rope | 100: offshore structure |
| 200: pulling chain | 300: ship |
| A: mooring system | |

INDUSTRIAL APPLICABILITY

The present disclosure is configured not only to facilitate mooring of an offshore structure but also to quickly and safely relocate a moored offshore structure in emergency situations such as port movement requirements for emergency maintenance or typhoons, so that the present disclosure has industrial applicability in relation to manufacturing of a mooring system for an offshore structure.

The invention claimed is:

1. A detachable mooring system for an offshore structure, the detachable mooring system comprising:

a first tension adjuster connected to an offshore structure to be a moored object, and configured to block advance of a pulling chain, which is inserted through an inlet of a body and is discharged out through an outlet thereof, in a direction from the outlet toward the inlet;

a second tension adjuster connected to one end of the pulling chain connected to an outer portion of the inlet of the first tension adjuster, and configured to block advance of the pulling chain, which is inserted through an inlet of a body and is discharged out through an outlet, in a direction from the outlet toward the inlet;

a mooring chain having a first longitudinal end connected to one surface of the body of the second tension adjuster, and having a second longitudinal end connected to an anchor settled on a seabed;

a first lead rope having one longitudinal end, which is connected to one end of the pulling chain discharged out through the outlet of the first tension adjuster;

a second lead rope having one longitudinal end connected to the body of the second tension adjuster; and a connecting rope connected to one end of the pulling chain discharged out through the outlet of the second tension adjuster, wherein each of the first tension adjuster and the second tension adjuster comprises: a pulley rotatably arranged at the body and brought into contact with the pulling chain; and a restrictor connected to the pulley, and configured to restrict uni-directional rotation of the pulley while being locked, wherein each of the first tension adjuster and the second tension adjuster further comprises a pulling member removing a locked state by pulling the restrictor, wherein a tension in a mooring state of the offshore structure is adjusted by pulling at least one of one end of the first lead rope connected to an end of the pulling chain exposed above a sea surface through the outlet of the first tension adjuster and one end of the connecting rope connected to the other end of the pulling chain located below the sea surface through the outlet of the second tension adjuster, through a winch installed on a ship at sea where the offshore structure is moored; and wherein the second tension adjuster and the mooring chain are towed by pulling the second lead rope through the winch placed on the ship.

2. The detachable mooring system of claim 1, wherein each of the first tension adjuster and the second tension adjuster further comprises a wireless controller configured to lock and unlock the restrictor in response to a control signal from a remote location.

3. The detachable mooring system of claim 1, wherein the second tension adjuster comprises a link member arranged at any one surface of the body to provide a binding portion of the second lead rope.

4. The detachable mooring system of claim 1, wherein the second tension adjuster comprises a binding member arranged at any one surface of the body and configured to bind the mooring chain.

* * * * *